US009810503B2

(12) United States Patent
Serviss

(10) Patent No.: US 9,810,503 B2
(45) Date of Patent: Nov. 7, 2017

(54) FOLDABLE FORCE CAPACITOR SPORT BOW

(71) Applicant: Aaron Serviss, Bloomingburg, NY (US)

(72) Inventor: Aaron Serviss, Bloomingburg, NY (US)

( * ) Notice: Subject to any disclaimer, the term of this patent is extended or adjusted under 35 U.S.C. 154(b) by 0 days.

(21) Appl. No.: 15/349,897

(22) Filed: Nov. 11, 2016

(65) Prior Publication Data

US 2017/0138690 A1 May 18, 2017

Related U.S. Application Data

(60) Provisional application No. 62/254,946, filed on Nov. 13, 2015.

(51) Int. Cl.

| | |
|---|---|
| ***F41B 5/00*** | (2006.01) |
| ***F41B 5/10*** | (2006.01) |
| ***F41B 5/14*** | (2006.01) |

(52) U.S. Cl.

CPC ..... *F41B 5/0094* (2013.01); *F41B 5/10* (2013.01); *F41B 5/1426* (2013.01); *F41B 5/1469* (2013.01)

(58) Field of Classification Search

CPC ..... F41B 5/00; F41B 5/10; F41B 5/0094
See application file for complete search history.

(56) References Cited

U.S. PATENT DOCUMENTS

| | | | | | |
|---|---|---|---|---|---|
| 428,912 | A * | 5/1890 | Holmes | F41B 5/0005 | 124/23.1 |
| 1,526,176 | A * | 2/1925 | O'Connell | F41B 5/143 | 124/24.1 |
| 2,714,377 | A * | 8/1955 | Mulkey | F41B 5/0094 | 124/23.1 |
| 3,552,373 | A * | 1/1971 | Van Hecke | F41B 5/0094 | 124/17 |
| 3,612,029 | A * | 10/1971 | Carroll | F41B 5/1407 | 124/92 |
| 3,628,519 | A * | 12/1971 | Hofmeister | F41B 5/0026 | 124/23.1 |
| 3,957,027 | A * | 5/1976 | Drake | F41B 5/0026 | 124/23.1 |
| 4,458,657 | A * | 7/1984 | Stockmar | F41B 5/0094 | 124/17 |
| 4,803,970 | A * | 2/1989 | Mattheck | F41B 5/0094 | 124/16 |
| 5,445,139 | A * | 8/1995 | Bybee | F41B 5/12 | 124/23.1 |
| 7,201,161 | B1 * | 4/2007 | York | F41B 5/0094 | 124/16 |
| 8,522,763 | B2 * | 9/2013 | Nebergall | F41B 5/10 | 124/25.6 |

* cited by examiner

*Primary Examiner* — John Ricci
(74) *Attorney, Agent, or Firm* — Wilson Dutra, PLLC; Camille A. Wilson

(57) ABSTRACT

The present invention relates to methods and apparatus that may enable the folding of a multi-point compression powered archery bow. More specifically, the present invention relates to a foldable archery bow, powered by multiple compression devices, wherein the upper limb and the lower limb may be drawn independently and released together. In some aspects, the bow may be adjustable for draw weight, draw length, and draw weight let-off at full draw length in a fixable frame that may be folded and unfolded.

16 Claims, 11 Drawing Sheets

FOLDABLE FORCE CAPACITOR SPORT BOW

CROSS-REFERENCE TO RELATED APPLICATION

This application claims priority to and the full benefit of U.S. Provisional Patent Application Ser. No. 62/254,946, filed Nov. 13, 2015, and titled "FOLDABLE FORCE CAPACITOR SPORT BOW", the entire contents of which are incorporated herein by reference.

BACKGROUND OF THE DISCLOSURE

The bow and arrow, a weapon that was originally made from bent wood held in tension by a string, was, as a product of the prehistoric age, simple to operate. Bows permitted hunting from a greater distance with greater accuracy and offered an alternative to short range encounters. As technology advanced, so did bows and arrows, with bows incorporating materials of the time in their progression, such as bronze or iron. Eventually, permutations of the bow design began to develop, including composite bows, longbows, crossbows, and compound bows. From ancient times to the Middle Ages, the bow was used as a primary military or hunting weapon. Now the bow has become more recreational in its use, such as when archery became an official Olympic sport.

Compound bows, in particular, have risen to prominence due to their use of cables and pulleys that make the bow easier to draw. Some versions of these bows use a two-pulley design while others use a pulley/cam system. These systems bend the limbs of the bow to aid a person when drawing an arrow while using a compound bow. There are a variety of cams that may be used, including, but not limited to, single, hybrid, binary, and twin cams. Each cam varies in terms of comfort, tuneability, quietness, draw length, let-off weight, and accuracy.

Cams have certain shortcomings that either inhibit a user from fully enjoying their compound bow or prevent them from unlocking its true potential. For example, cams have inconsistent energy requirements for drawing back the string, with uneven load distribution for drawing and releasing. Cams are typically loud and do not allow dry fire. There are also form factor issues that inhibit the portability of a compound bow.

Another problem with compound bows that has become increasingly controversial is the potential for cruelty to the hunted animals. Animals are particularly sensitive to sound, and the noise from firing a compound or cross bow often causes the animal to move more quickly than an arrow can reach it. Accordingly, the arrow may severely wound the animal and prolong suffering, sometimes even allowing the wounded animal to flee in pain. The compound bow also requires the archer to use significant power to draw back a bow that has the capability of fatally striking an animal. Many people often utilize a compound bow far below that necessary power, and the arrows again simply wound the animal, which may unnecessarily prolong their suffering or allow an injured animal to limp away.

SUMMARY OF THE DISCLOSURE

There are many design aspects of a foldable archery bow that may result in improved operation and performance. For example, an archery bow that may be stored and carried in a compact folded form and routinely unfolded to a usable form in a short amount of time is highly desirable. The present designs generally all lack the ability to perform this task while being compact, easily and independently adjustable, simplistic, cost effective, and aesthetically pleasing.

Furthermore, a highly desirable aspect may be a bow design which allows for a larger amount of force to be imparted to an arrow than is required to draw the arrow. Some compound bow designs may afford such an advantage while having other disadvantages, such as being significantly susceptible to catastrophic or even dangerous failure resulting from being released without a loaded arrow upon the drawstring.

Accordingly, the present disclosure relates to a multiple compression powered rigid limb bow that may overcome the deficiencies of the prior art. The described bow may present a contemporary, more simplistic design having an independently and more fully and easily adjustable draw weight and let-off features, which may enable an arrow to be accurately shot with a high level of substantially vibrationless high energy. In some aspects, foldable embodiments of the bow may overcome issues of portability associated with prior art.

The present disclosure relates to an archery bow comprising an upper limb; a lower limb; a grip portion for grasping the archery bow, where the grip portion connects the upper limb and the lower limb; an upper force capacitor connected to the upper limb, where the upper force capacitor allows for an upper let off; a lower force capacitor connected to the lower limb, where the lower force capacitor allows for a lower let off independent of the upper let off; and a drawstring connecting the upper force capacitor and the lower force capacitor, where a first draw of the drawstring engages the upper force capacitor, a second draw of the drawstring engages the lower force capacitor, and a release of the drawstring releases both the first draw.

Implementations may include one or more of the following features. The archery bow may further comprise an upper eccentric, where the drawstring engages the upper force capacitor through a rotation of the upper eccentric; and a lower eccentric, where the drawstring engages the lower force capacitor through a rotation of the lower eccentric.

The drawstring may further comprise a nock, where the nock is configured to fit an arrow to the drawstring. In some aspects, the nock may travel a first distance during the first draw, a second distance during the second draw, and a third distance during the release. In some embodiments, a summation of the first distance and the second distance may exceed the third distance. In some implementations, the upper eccentric may comprise a first shape and the lower eccentric may comprise a second shape, wherein the shapes may be the same or different.

In some aspects, the archery bow may be foldable, wherein the archery bow may comprise a folded orientation and a deployed orientation, where the archery bow is operable in the deployed orientation. In some embodiments, the upper limb may include a first folding point, the lower limb may include a second folding point, the connection point between the grip portion and the upper limb may include the third folding point, and the connection point between the grip portion and the lower limb may include the fourth folding point. In some aspects, the archery bow may further comprise a folded locking mechanism, where the folded locking mechanism secures the archery bow in the folded orientation. The archery bow may further comprise a deployed locking mechanism, where the deployed locking mechanism secures the archery bow in the deployed orientation. In some embodiments, the force capacitor may be configured to disassemble.

In some aspects, the archery bow may further comprise a release mechanism configured to release the drawstring once engaged, wherein the release mechanism may be located on the grip portion or on one or both the lower limb or the upper limb. In some implementations, the drawstring may comprise a noise dampening material.

In some embodiments, the upper force capacitor may comprise a first spring system and the lower force capacitor may comprise a second spring system. In some aspects, the upper force capacitor may comprise a first pneumatic mechanism and the lower force capacitor may comprise a second pneumatic mechanism. In some implementations, the upper force capacitor may comprise a first magnetic mechanism and the lower force capacitor may comprise a second magnetic mechanism.

BRIEF DESCRIPTION OF THE DRAWINGS

The accompanying drawings, which are incorporated in and constitute a part of this specification, illustrate several embodiments of the disclosure and, together with the description, serve to explain the principles of the disclosure.

DETAILED DESCRIPTION

Figure 1:
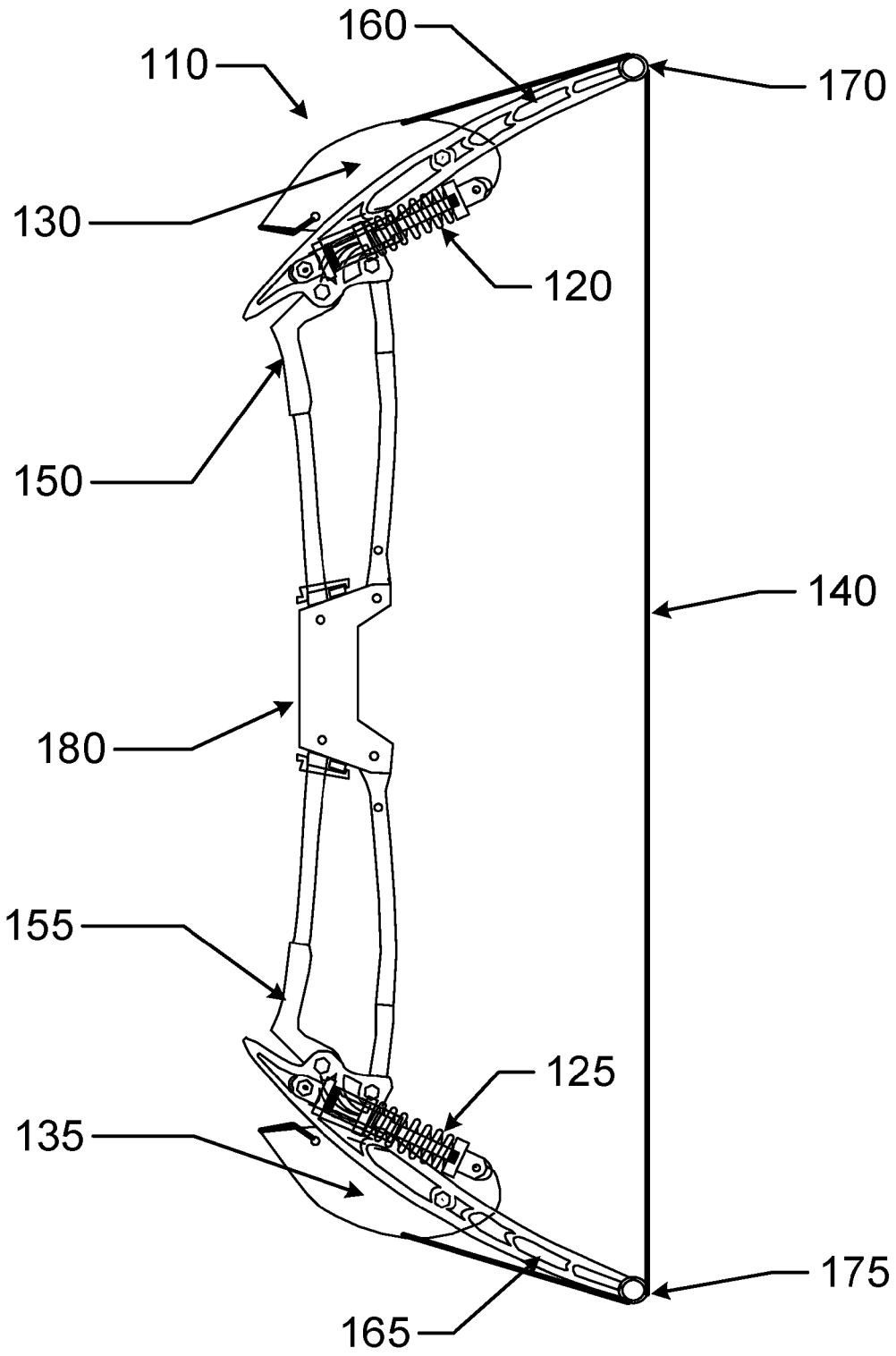
FIG. 1 illustrates an exemplary embodiment of a foldable bow with dual force capacitors.

The present invention relates to methods and apparatus that may enable the folding of a multi-point compression powered archery bow. More specifically, the present invention relates generally to a foldable archery bow, powered by multiple compression devices. The bow may be adjustable for draw weight, draw length, and draw weight let-off at full draw length in a fixable frame that may be folded and unfolded.

The multi-point compression power devices may be independently engaged which may result in a doubling of the effective strength of a particular draw force when the bow is engaged. The compression power devices may be coupled with eccentrics to program by design the force versus draw characteristics as well as the force imparted to the arrow over time during release. Various eccentric designs may be incorporated for different desired force versus draw characteristics. The compression devices may comprise various energy storage mechanisms and may include straight forward mechanisms to adjust the compression and tension characteristics.

In the following sections, detailed descriptions of examples and methods of the disclosure will be given. The description of both preferred and alternative examples though thorough are exemplary only, and it is understood that to those skilled in the art variations, modifications, and alterations may be apparent. It is therefore to be understood that the examples do not limit the broadness of the aspects of the underlying disclosure as defined by the claims.

Glossary

Force capacitor: as used herein refers to a means of storing mechanical energy with the intent of releasing said energy. Variants of force capacitors and their resistant qualities may utilize mechanical springs, compressed gas, a combination of compressed gas and liquid as well as magnetic flux and other unconventional means.

Eccentric: as used herein refers to a component that may be used to transfer energy via leverage from the bowstring to the force capacitor in a non-linear profile. In some aspects, the shape of the curve in which the string rests may be eccentric in relation to the rotation of the component. To distinguish this component from the cam of a compound bow, it must be understood that a cam rotates in relation to the opposing cam and transmits tensile force to the limbs. In contrast, an eccentric rotates significantly less and produces compression force directly to the force capacitor, with no inherent relation to the opposing eccentric.

Independent: as used herein refers to the distinct engagement, draw, and release of each force capacitor, wherein independent control may occur due to the isolation of each from one another as well as the integration of separate let-offs for each. This form of draw effectively halves the amount of strength needed to draw the bow, in relation to the amount of strength needed to draw a compound bow of similar conventional draw weight. Independent is used in contrast to conventional or traditional draw, wherein both limbs are drawn upon simultaneously and equally.

Power profile: as used herein refers to a draw profile, describing the resistance rate as the draw progresses. This is often laid out in a graph marked with inch of draw and resistance present. Power profiles also may include the distance from rest to let-off as well as the percentage of let-off achieved and possibly the length of the let-off valley.

Let-off: as used herein refers to the resting position at full draw wherein the majority of resistance is eliminated to allow the draw to be held with minimal strain. The let-off is often present for a short distance of the draw length. As an example, a bow with a 29 inch draw length may achieve let-off at 28½ inches. This ½ inch difference is known as "the valley," and is beneficial as it allows for slight motion without loss of let-off and 'shooting from the valley' or releasing.

Referring to FIG. 1, some elements of an exemplary force capacitor sport bow 110 may be found. The force capacitor sport bow 110 may have a number of force capacitors including in this embodiment an upper force capacitor 120 and a lower force capacitor 125 enabling the desired operation of the bow. The force capacitors may function to store and release the energy given to the force capacitor sport bow 110 by the user. In some implementations, the force capacitors may function to store this energy through the compression of a spring system, which may include a mechanical spring, hydraulic fluid, pneudraulic fluid mixture, pneumatic fluid mixture, air spring, pressurized gas, such as CO2 as a non-limiting example, permanent magnets, electromagnets, or by other means.

In some aspects, an exemplary spring system based force capacitor may also contain a level of pre-stress, whereupon the equilibrium state of the bow may impart a small level of compression upon the draw string. Pre-stress may be minimal or absent when the bow is in a folded or disassembled configuration. By holding its actuated position, the force capacitors may continue to store the energy imparted by the user, until the system may be released and therefore to release the energy. In some implementations, the force capacitors may release energy by decompressing a spring system.

In some embodiments, multiple force capacitors may function on a single bow, such that, for example, an upper force capacitor 120 and lower force capacitor 125 may achieve the storage, containment, and releasing of energy towards the desired functionality of the bow. In some aspects, these force capacitors 120, 125 may function either simultaneously or independent of each other, and as such, the other components that the force capacitors interact with may also function independently of the corresponding components on the other side of the bow.

In some implementations, the force capacitor sport bow 110 may have a number of eccentrics enabling exemplary desired operation of a bow. In some embodiments, the eccentrics, including an upper eccentric 130 and a lower eccentric 135 may function to rotate and translate energy to the force capacitors to be stored. In some aspects, the eccentrics may function to translate the energy released by the force capacitors to the arrow based on their shape. In some implementations, the eccentrics may have a geometry that affects the power profile of the energy stored in and released by the bow; this geometry may have an eccentric outer profile where the bow string 140 may ride upon.

In some embodiments, the eccentric geometry may allow for different power profiles, including, but not limited to, a flat power profile. In some aspects, a flat power profile may describe a power profile where a constant force may be imparted by the user to further compress the possible spring system of the force capacitors. In some embodiments, an eccentric to force capacitor geometry may have a varying location for the pivot point of the eccentrics. In some aspects, the connection points between the eccentrics and force capacitors and between the eccentrics and the bow string may have numerous options. For example, as with the multiple force capacitors such as the upper force capacitor 120 and lower force capacitor 125 acting in concert, the multiple eccentrics may act towards the same function described above. In some embodiments, the multiple eccentric and force capacitors may also act independently on different halves of the bow.

In some aspects, the force capacitor sport bow 110 may comprise a bow string 140. In some implementations, the bow string 140 may function as a point of contact between the user and the bow, wherein a user may pull on, or otherwise actuate, the bow string to move the eccentrics and store the imparted energy in the force capacitors. In some embodiments, the bow string 140 may have a point of contact whereupon an object, such as an arrow, is temporarily secured to the bow string 140. In some aspects, when actuated, the bow string 140 may be pulled back along with the arrow and when released, the energy stored in the force capacitors may be translated through the eccentrics to the bow string 140. This release process may be called "firing" the arrow. In some embodiments, the geometry of the bow string 140, eccentrics, and force capacitors may be such that when the bow string 140 is released, the arrow may travel in a straight horizontal path, as may be desired for proper operation of the bow in some aspects. In some implementations, as a non-limiting example, when the bow is in a folded position there may be extra wheels that may hold the slack of the bow string 140 while folded.

In some embodiments, the bow string may be attached to the different eccentrics such as the upper eccentric 130, and lower eccentric 135, which may operate upon different halves of the bow. In some aspects, these elements may operate together or independent of each other. In some implementations, the material of the bow string 140 may affect its functionality and thus, that of the entire bow. In some embodiments, the bow string may also be outfitted with a release system that may retain the compression of the force capacitors 120 after energy has been stored within them.

In some aspects, this release system may comprise a safety mechanism that may prevent the user from storing energy in the bow, rendering the bow inert. In some implementations, this release mechanism may be located in multiple positions on the bow including, but not limited to, on the grip or limbs of the bow. In some embodiments, this release mechanism may comprise multiple locking systems that engage within a foldable or disassemble-able bow to prevent the bow from converting to its compact size when it is deployed.

In some implementations, the force capacitor sport bow 110 may have a deployment system 150 enabling the device to be transformed into a more compact size when it is not in use. In some aspects, this deployment system 150 may include various types, geometries, and arrangements of hinges that allow the bow to be folded into a compact size. In some embodiments, these components may be located on both the upper half and the lower half of the bow to fold the bow. Depending upon these hinges, this folding may occur along the length of the bow, or across the bow, as non-limiting examples. These hinges may be fitted with, as a non-limiting example, rotary or linear springs that may aid in either folding or deploying of the bow. In some aspects, a rubber band, bow flex, or related material may be installed between the deployment system 150 and the force capacitor sport bow 110 to aid in its folding capabilities and assembly.

In some embodiments, the deployment system 150 may comprise various types, geometries, and arrangements of removable pins that allow the bow to be disassembled to a compact size. In some implementations, a disassembly system may have a different number and/or weight of components than a possible folding arrangement of a deployment system 150. In some embodiments, these different arrangements may result in differing weights, compact sizes, and convenience of deployment for the bow. In some aspects, the deployment system 150 may comprise additional wheels for collecting the slack of the bow string 140 to further increase the compatibility of the design and/or prevent damage to the bow string 140 when the bow is stored in its compact size.

In some aspects, the force capacitor sport bow 110 may comprise limbs such as an upper limb 160 and a lower limb 165 that suit different functional purposes for the bow. In some implementations, the limbs may be formed from various materials, including, but not limited to, titanium, steel, aluminum, carbon fiber reinforced polymer, composites of multiple types of materials, and other materials that may give the bow varying weights and strengths. In some aspects, the bow string 140 may comprise a noise dampening material.

In some implementations, the limbs may dampen noise from the bow during use. In some aspects, the limbs may be fixed or have their own isolated movement, independent from any springs or other moving elements of the bow. The limbs may provide attachment and support points to the springs used in the force capacitors as well as the eccentrics attached to both the force capacitor and pivot points anchored to the eccentrics. In some aspects, limbs may be optimized, in terms of materials and geometries, either for comfort, durability, efficiency, or other possible desired characteristics for the bow. In some implementations, the limbs may be altered depending on the type of shooting that will be performed, such as for stationary targets, or for hunting, as non-limiting examples. In some embodiments, the limbs, eccentrics and/or the force capacitors may be altered depending on the size, age or other biometrics of a user.

As with the multiple force capacitors which may act independently and in concert with the different halves of the bow, in some aspects multiple limbs, such as upper limb 160 and lower limb 165, may also act towards the same function described above, but independently on different halves of the bow. In some implementations, these limbs may also support or attach to pulleys, springs, hinges, or other functional and/or movable components that contribute to the overall functionality of the bow. In some aspects, there may be a pulley 170 on the upper limb 160 and a pulley 175 on the lower limb 165 that serve as points of contact between the bow string 140 and each of the limbs 160, 165, to aid in actuation of the bow.

In some embodiments, a user may employ a handle 180 or grip with which to hold the bow in one hand, using the second hand to actuate the bow string 140. In some aspects, a deployment system 150, including a lower deployment system 155, of the force capacitor sport bow 110 may have a trigger mechanism to initiate deployment of the bow located within the bow's handle 180. In some implementations, this trigger mechanism may comprise a combination of hinges and springs, wherein a trigger mechanism may be engaged by a user depressing the trigger. In some embodiments, the depression of the trigger may move a series of stops to free the path for primed springs to push the limbs of the bow into a deployed position. In some aspects, this action may be reversed by pushing the limbs of the bow out of the deployed position, storing energy in the springs, and priming the trigger mechanism for use. In some implementations, this reverse action where the limbs may be folded away from a deployed mechanism may result in a compact folded bow.

Figure 2:
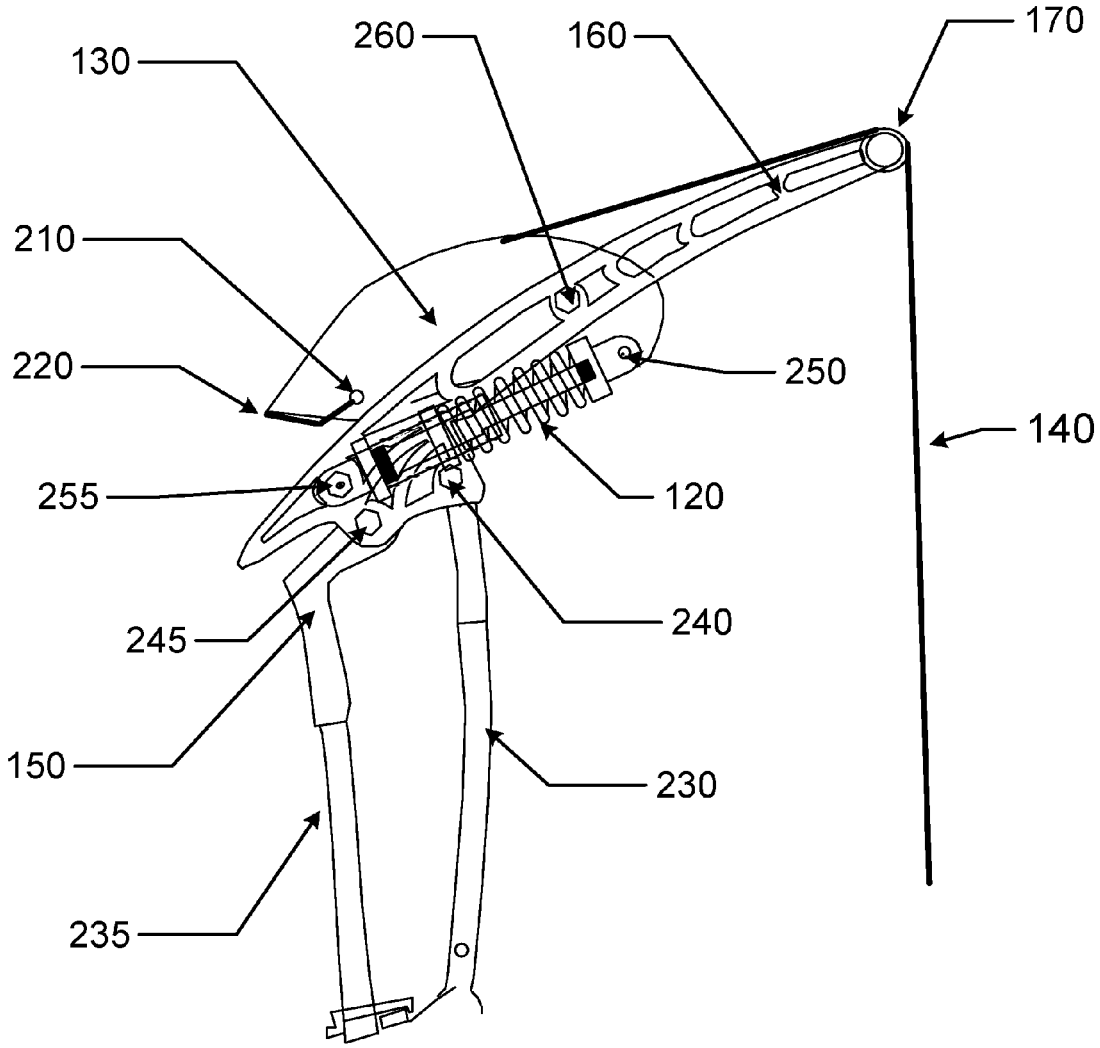
FIG. 2 illustrates an enlarged view of the upper limb of an exemplary foldable bow.

Referring now to FIG. 2, an enlarged view of the upper limb of the exemplary foldable bow is illustrated. As the functionality of the upper and lower halves may operate independently of each other, the functionality of the lower half of an exemplary bow may be understood as analogous to that of the upper half of an exemplary bow, described below. In some embodiments, an attachment point for the bow string 140 may be a hole 210 in the upper eccentric 130. In some aspects, the bow string 140 may then be fed along a slot 220 in the upper eccentric 130 and around the outer perimeter of the upper eccentric 130 to a pulley 170 on the upper limb 160.

In some embodiments, one end of the upper force capacitor 120 may be attached to an attach pivot 250 on the upper eccentric 130 and the other end may be attached to an attach pivot 255 on the upper limb 160. In some aspects, when the bow string 140 is actuated by the user, it may pull the upper eccentric 130 and rotate it around the eccentric pivot 260, attaching the upper eccentric 130 to the upper limb 160. In some implementations, through this motion, the upper eccentric 130 may be able to compress the upper force capacitor 120, thus storing the energy imparted by the user into the upper force capacitor 120.

In some aspects, the force required to compress a spring to store mechanical energy in it, as with the force capacitor 120, increases as the spring is compressed; however, when the eccentric 130 rotates, depending upon its geometry (relating to the locations of the attach pivots 250, 255 relative to the eccentric pivot 260, as well as the outer profile of the eccentric), the tension on the bow string 140, varies as the force capacitor 120 is compressed in a manner that depends on the design settings of all these various components and attachment locations.

In some embodiments, the action of the eccentric may result in different force profile being required to draw back a bow string than is actually imparted upon the force capacitor 120 to compress it, such as differential or conventional draw. In some aspects, the eccentric 130 may have different shapes, such as oval, asymmetrical, circular, or others, that may each have a different effect on the so called 'power profile' of the bow, which is referring to the force imparted by the user with respect to the amount of deflection during the pull. In some implementations, these shapes, along with other variations in the construction or tuning of the bow, may result in a symmetric or asymmetric geometry in the bow and may also result in a symmetric or asymmetric delivery of power, with regards to the desired power profile, as the energy stored in the bow is released.

Variations in design may result in different amounts of draw force being required to compress the force capacitors. In some aspects, a different power profile may change the ease with which the user can pull the bow string 140 at different points of the draw. As a non-limiting example, the user may desire the force required for drawing the bow string 140 to be constant over the course of the draw. When the user then releases the bow string 140, the upper force capacitor may be free to decompress. With this freedom, the spring may move the eccentric with an opposite motion to that which stored the energy in the force capacitor, resulting in a pivot of the upper eccentric 130. When the eccentric pivots, bow string 140 may be pulled into its taut position, with a certain speed and force consistent with the desired operation of the bow and the designed aspects of the components.

The bow string 140 may also have a so-called 'nock', used to hold the arrow in place. During the firing of the bow, the bow string 140 may allow for the nock to have a horizontal movement, or may allow for the nock to have an adjustable position and movement during firing, depending upon the performance desired by the user. In some aspects, the nock travel distance may be limited during the release, wherein the nock travel distance that may occur during the independent draw of the upper eccentric 130 and the lower eccentric 135 may exceed the nock travel distance during the simultaneous release of the draw.

Continuing with reference to FIG. 2, the deployment mechanism 150 of the bow may also be exemplified. In some embodiments, the bow may have upper and lower risers that allow for pivoting motion while holding components of the bow in place. For example, an inner riser 230 and outer riser 235 may be attached to the upper limb 160 of the bow at attach pivots 240 and 245, respectively. With these pivots, when the deployment mechanism is actuated by the user, the parts connected at attach pivots 240 and 245 may be allowed to rotate, bringing the upper limb 160 and inner riser 230 closer together.

In some aspects, the bow may have locking mechanisms, located at various points upon or within the components of the deployment mechanism 150, to keep the bow locked in either a deployed or a folded shape, as desired by the user. In some embodiments, a locking mechanism may engage when the bow is fully deployed preventing the limbs from collapsing or folding. In some implementations, a user may engage a locking mechanism to stabilize the bow in a folded position, wherein the locking mechanism may limit shifting of the components protecting the bow during transportation.

Figure 3:
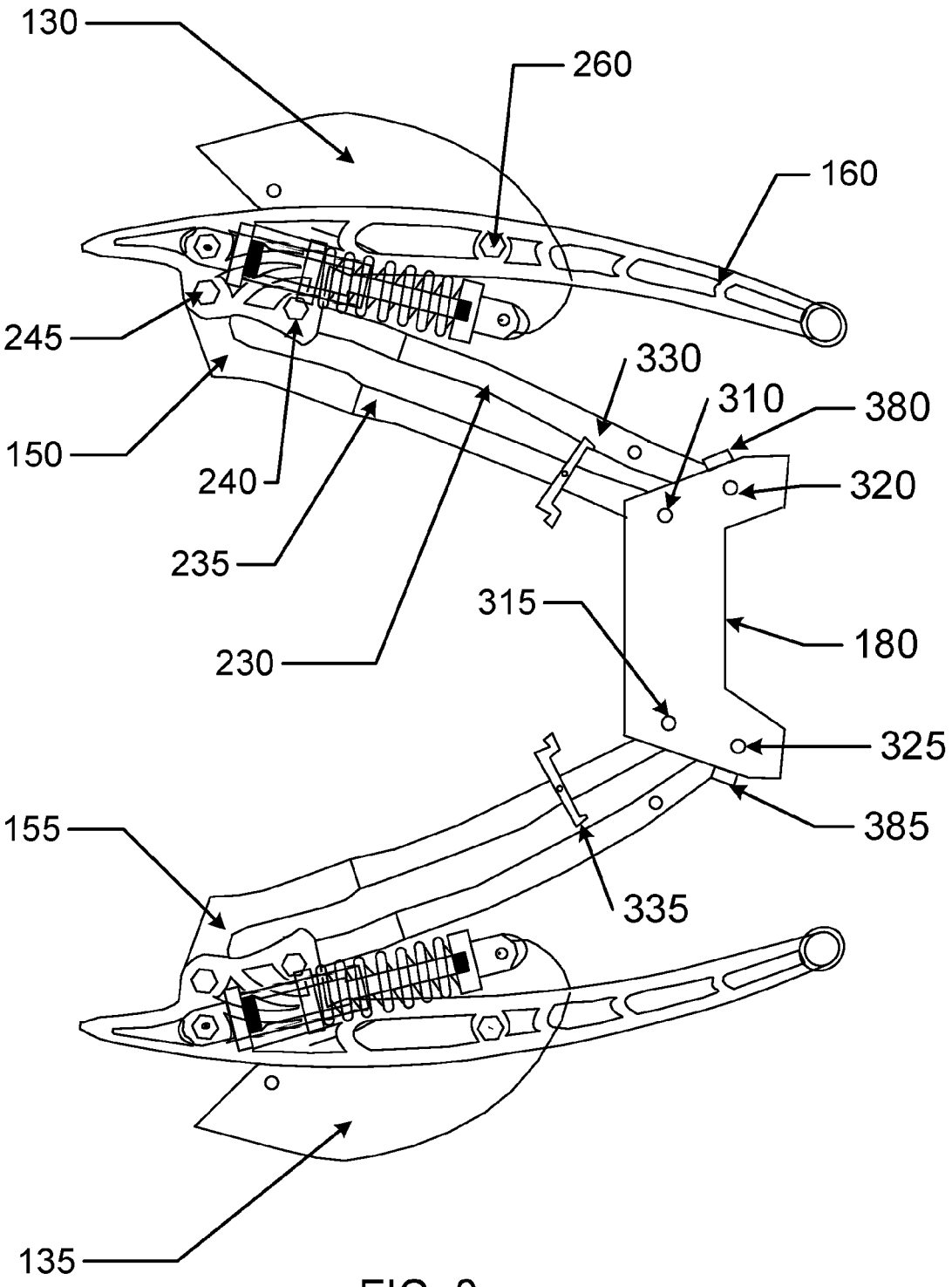
FIG. 3 illustrates an exemplary foldable bow in a folded state.

Referring now to FIG. 3, a view of an exemplary folded shape of the exemplary foldable bow may be illustrated. In some embodiments, folding the bow into the depicted shape in FIG. 3 may be achieved through actuation of the deployment mechanism. In some aspects, the upper limb 160 and inner 230 and outer 235 risers may move upon activation as delineated in the description of FIG. 2. In some implementations, the deployment mechanism 150 may be activated through means of a trigger mechanism located within the bow's handle 180, or by other possible means. Upon actuation of the deployment mechanism 150, the inner 230 and outer 235 risers may be allowed to rotate, with respect to the handle 180, about attach pivots 310 and 320, respectively.

In some embodiments, the bow limbs and risers may be symmetric for lower and upper assemblies. Due to this illustrated symmetry about the handle, in terms of both functionality and geometry, a similar rotation may occur about attach points 315 and 325, for the lower half of the bow. In some implementations, as a possible method for locking the bow in place when in a deployed arrangement, an upper half latch 330 and a lower half latch 335 of the bow may be secured on mounting points such as an upper mounting point 380 and a lower mounting point 385, respectively, secured to the handle 180 of the bow. In some aspects, these latches may be spring loaded to help secure the latches in place when securing the bow in a deployed arrangement. In some embodiments, by releasing the latches, a user may adjust the bow into the folded shape illustrated in FIG. 3. In some aspects, The parts of the bow near each of the attach pivots, on both the upper and lower halves of the bow, may also be spring loaded, to supply the force needed to rotate these parts of the bow into the deployed position.

Figure 4:
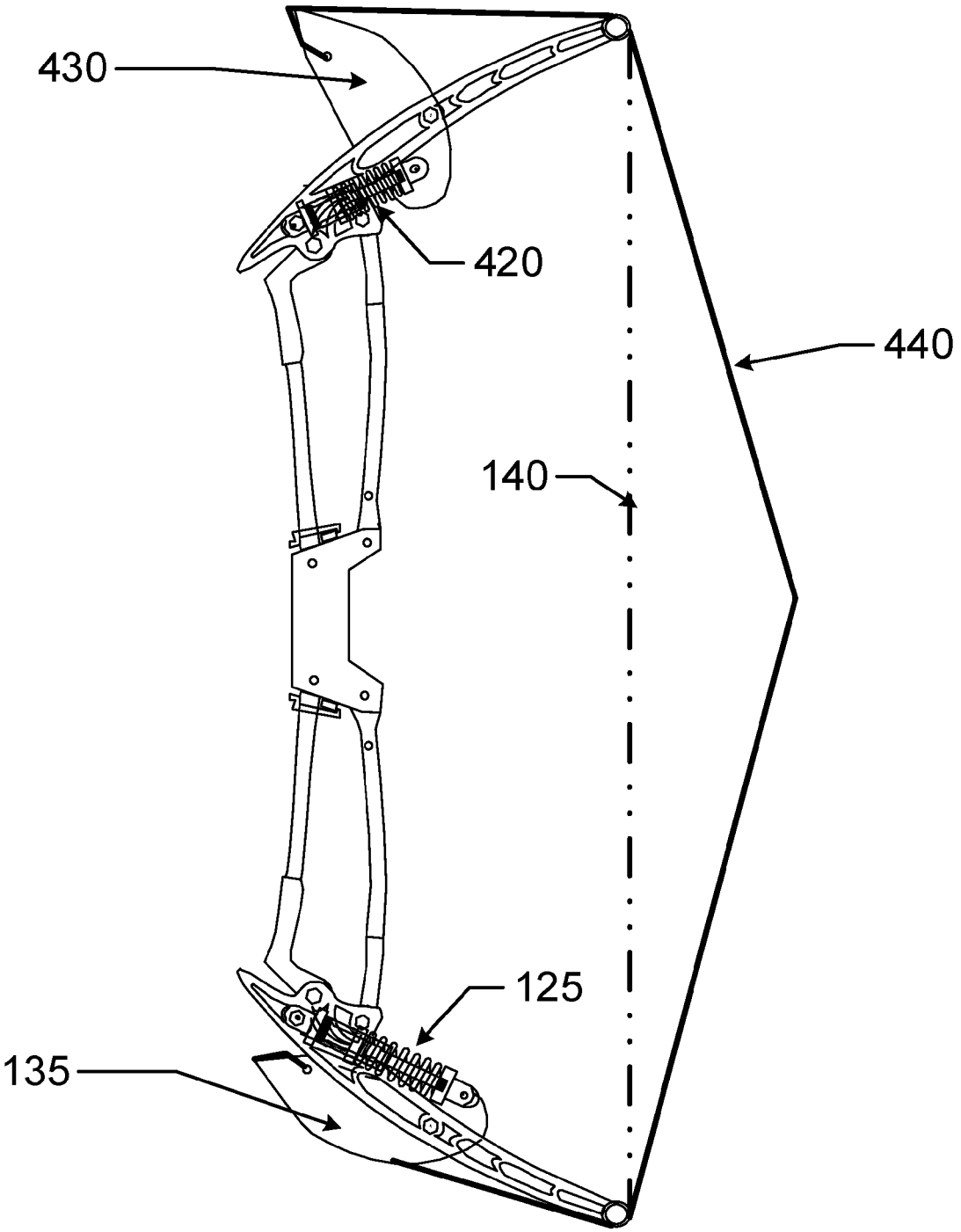
FIG. 4 illustrates an exemplary foldable bow with a single force capacitor energized.

Referring now to FIG. 4, a view of an exemplary engaged bow with a single force capacitor engaged is illustrated. As described previously, when the bow string 140 is actuated by the user and pulled from its taut position to an actuated position 440, a force capacitor may be compressed 420 as the eccentric is rotated into its actuated position 430. In some aspects, there may be an independent nature of the upper force capacitor 120 and lower force capacitor 125. Thus, in some embodiments, it may be possible to activate one of the force capacitors before the second one may be activated. In some implementations, the actuation of one force capacitor may occur without the actuation of the other, as illustrated in FIG. 4. In some aspects, the user may influence the actuation of the one force capacitor activated by selectively applying force towards that force capacitor, in other examples, the activation of a single force capacitor may naturally occur based on relative settings and performance of the two force capacitors.

Figure 5:
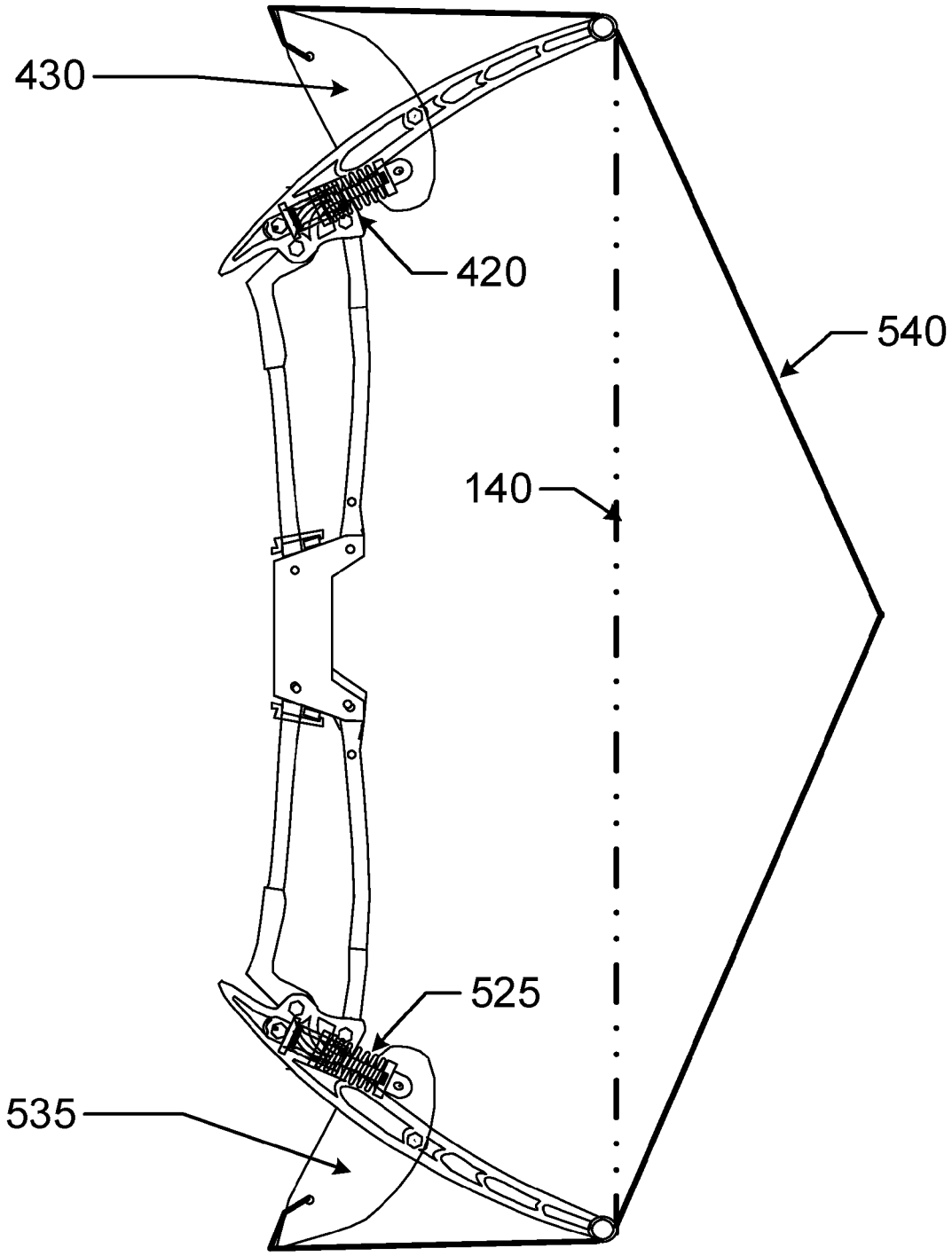
FIG. 5 illustrates an exemplary foldable bow with two force capacitors energized.

Referring now to FIG. 5, a view of an exemplary engaged bow with both force capacitors engaged is illustrated. In some embodiments, the lower force capacitor may now be compressed 526 as the lower eccentric is rotated into its actuated position 535. In some aspects, with both force capacitors engaged, when the bow string 540 is released, both force capacitors may discharge and release twice the force as if just one force capacitor was engaged. In some embodiments, the force capacitors may be compressed independently, by compressing one at a time, wherein the force out of the bow may exceed the force employed by the user in activating the force capacitors independently. In some aspects, by adjusting the tolerance and calibration of the bow components, the result may be that when the bow string is released, even though the upper and lower bow firing systems are independent, they may activate and function at the same time, thus allowing the arrow to have a straight, horizontal path as it leaves the bow. The force required to hold the bow in this actuated position may be much less than the force required to load the force capacitors 420, 525.

Examples of Force Capacitors

Figure 6A:
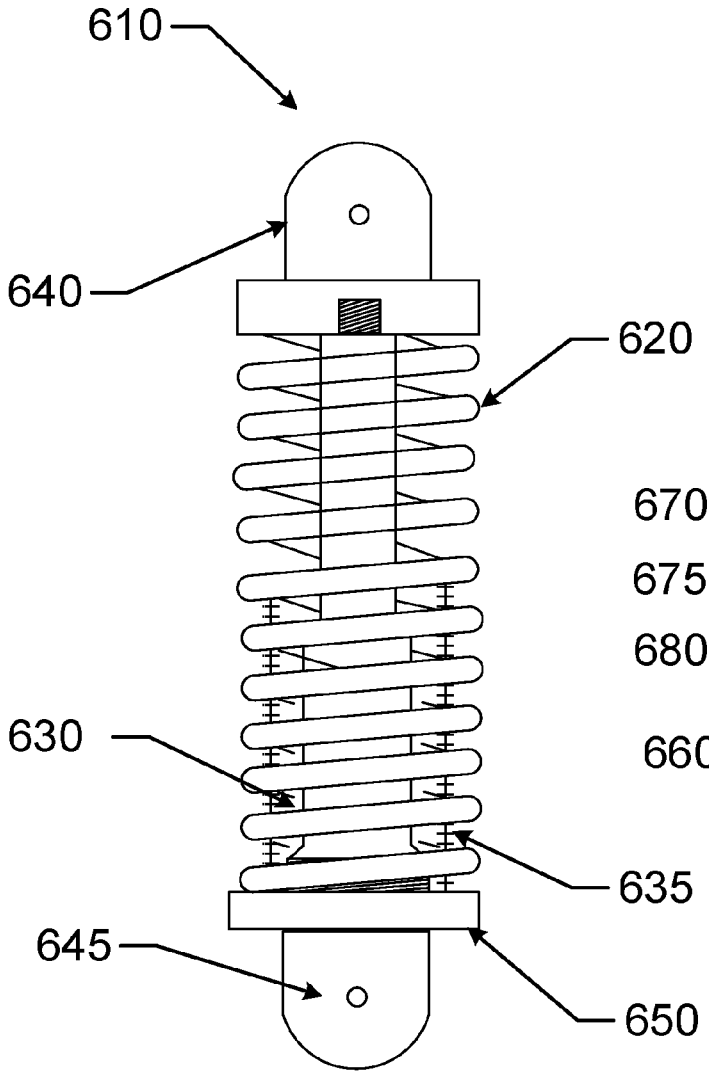
FIG. 6A illustrates aspects of spring-based force capacitors with a gas compression piston in cylinder complementary function.
Figure 6B:
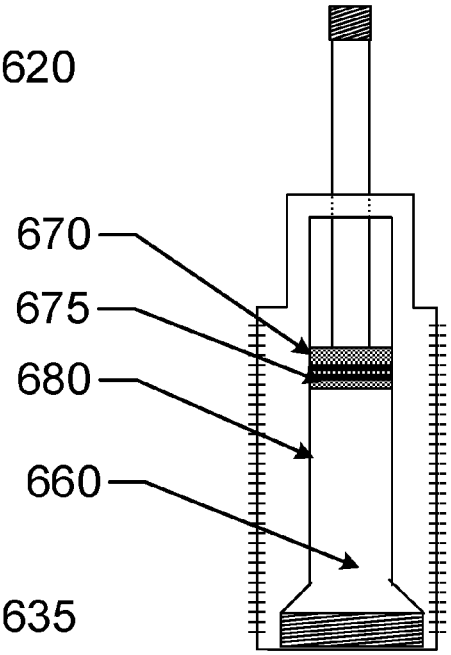
FIG. 6B illustrates aspects of a spring-based force capacitors with a gas compression piston in cylinder complementary function.

Referring now to FIG. 6A, an exemplary force capacitor 610 is illustrated with a cross-section illustration in FIG. 6B. In some embodiments, this example may contain a spring element 620, and a piston 670 contained within the interior section 660 of a cylinder 630 to guide the piston's motion. In some implementations, the piston 670 may be screwed into a connecting hinge 640. In some aspects, the cylinder 630, may respectively be connected to a second connecting hinge 645 via threads on the interior section 660 of the cylinder 630. In some implementations, these connecting hinges may connect the force capacitor to other functional parts of the bow. In some embodiments, the piston 670 and cylinder 630 may be contained within the center of the spring element 620 so that all three share a central axis. In some implementations, the cylinder 630 may be constructed with exterior threading 635 that may mate with an annular nut 650, constraining the spring element 620 between the annular nut 650 and the connecting hinge 640 that attaches to the piston 670. In some aspects, it may be possible to adjust the position of this annular nut 650 on the outer cylinder threads of the exterior threading 635. In so doing, the equilibrium compression of the spring element 620 may be varied. In some implementations, this variation may adjust the initial force that the user must impart to use the bow, as well as the maximum amount of energy that the user may impart over the duration of the draw.

Within this exemplary force capacitor 610, its components allow it to redirect, store, and then dissipate energy imparted into the bow, each in a controlled manner as dictated by the user. When the user draws the bow, energy is imparted to the force capacitor, compressing the spring element 620. The energy is then stored in the spring in accordance with Hooke's law; the energy put into the bow exerts a force on the spring, compressing it in accordance with the equation $F=kx$, with F representing the magnitude of the exerted force, x representing the distance the applied force compresses the spring, and k representing what is commonly referred to as a "spring constant," a numerical constant dependent upon the material properties and geometry of the spring. By this equation, as the force imparted upon the spring element 620 increases, it further compresses the spring. In the embodiment displayed in FIG. 6A, the gas entrapped in the cylinder also acts as a compressive energy store when the gas internal to the cylinder is compressed over ambient pressure. In some aspects, a force capacitor (not shown) may comprise a heating piston, which may increase the energy released, such as wherein a liquid may be converted to steam.

With bow constructions, as with this example, it may be desired to impart a level of pre-stress upon the force capacitor 610, meaning that the geometry and construction of the entire bow is such that, in the bow's equilibrium position, the spring element 620 of the force capacitor 610 is already compressed past its equilibrium position to some degree. This may be desirable for certain bow constructions because the geometry and construction of the bow may make it so the greatest draw force needed to use the bow is that which causes the initial stress on the bow; as such this pre-stress removes this large initial force, as it is already held within the bow. In some embodiments, there may be numerous adjustments related to the force capacitor that may affect the draw conditions of the bow at various stages of the bow including, as non-limiting examples, materials of the spring, adjustments on the static spring tension, equilibrium gas pressure in the cylinder.

Once the full force has been imparted upon the force capacitor 610 to fully compress the spring element 620, as long as the force capacitor 610 is held in this compressed state, the energy that was imparted into it will be stored within the system. It may thus be stored until the imparted force vanishes. This may occur when the draw string is released, and at that point, the force capacitor 610 will rapidly dissipate its energy through a force versus acceleration relationship affected by the shape of the eccentric amongst other considerations. The various pivot points may experience frictional forces during the movement, as an example of other considerations and this effect may be modified by use of sliding materials, lubricants, bearing and the like.

Referring still to FIGS. 6A and 6B, a function of the interior cylinder section 660 and piston 670 of this exemplary force capacitor 610 construction may introduce what is commonly referred to as "damping." In an oscillatory function, damping functions to steadily decrease its amplitude over time; with a bow, however, the initial cycle is important (that which imparts the stored energy to the fired object), and thus damping serves to effect the speed at which the stored energy is imparted to the fired object as well as the rate of stopping at the end of the initial cycle among other effects.

Greater damping results in a smaller impulse, meaning the energy is imparted at a slower rate. In some implementations, this damping may occur in the system as the piston 670 moves as the spring is decompressed. This movement in the piston pulls the piston 670 out of the cylinder. During the movement of the piston 670, one or more O-rings 675 along the circumference of the piston 670 may create an air-tight seal between the piston 670 and the interior cylinder section 680. In some embodiments, the gas inside the cylinder decompresses creating a force that works against that of the decompressing spring 620, lessening its effect on the system.

The effect of this damping is related to the velocity of the piston 670, as well as the properties of the fluid contained within the interior section 660 of the cylinder. Thus, the previously stated Hooke's Law equation is modified with damping present to $F=kx-cv$, with v representing the velocity of the piston 670, and c representing what is commonly referred to as a "damping coefficient," determined by the properties of the fluid, as well as the geometry of the system. This addition to the equation is important because it introduces a time dependence not previously present in the original equation. As the spring 620 moves and the piston 670 moves with it, the pressure difference also adds a secondary spring effect. In some embodiments, the design of the bow may incorporate initial design points for the interaction of these elements, and adjustment points may allow for variation during use.

As previously stated, the exemplary force capacitor 610 illustrated in FIGS. 6A and 6B is but one possible construction of such a device, which functions to build up, store, and release stored mechanical energy in a controlled manner. There may be numerous alterations relating to the nature of the compressive elements which may be varied.

Figure 7A:
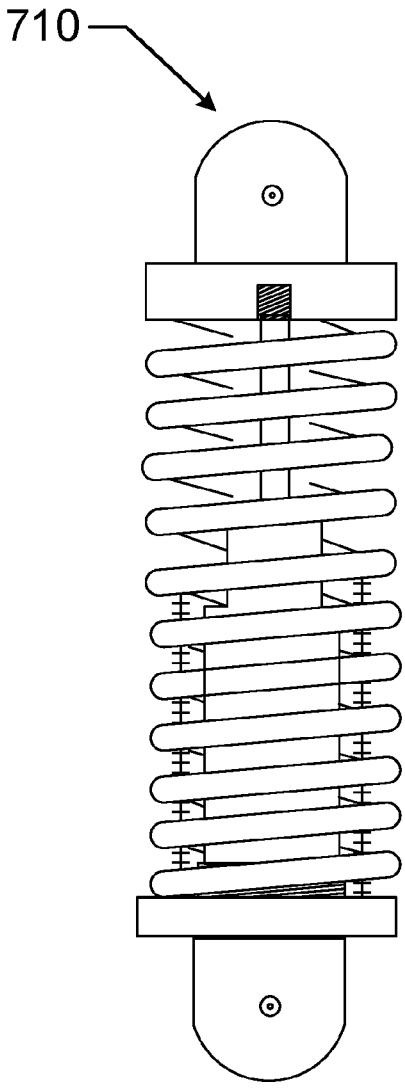
FIG. 7A illustrates aspects of a spring-based force capacitor with a gas compression piston in cylinder complementary function where the piston has release holes that allow gas to flow from either cylinder side to the other.
Figure 7B:
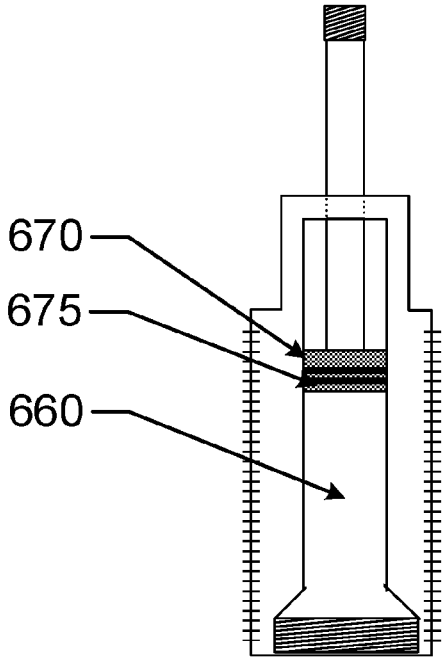
FIG. 7B illustrates aspects of a spring-based force capacitor with a gas compression piston in cylinder complementary function where the piston has release holes that allow gas to flow from either cylinder side to the other.
Figure 7C:
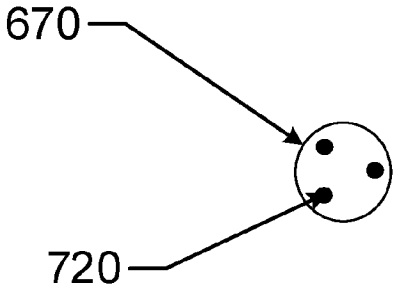
FIG. 7C illustrates aspects of a spring-based force capacitor with a gas compression piston in cylinder complementary function where the piston has release holes that allow gas to flow from either cylinder side to the other.

Referring now to FIGS. 7A, 7B, and 7C, a similar exemplary force capacitor 710 to that in FIG. 6 is illustrated, with similar operation in many ways except that in some aspects piston 670 may have holes 720 cut in the section of it that mates with the interior cylinder section 660. These holes allow this construction to circumvent or lessen the damping effect illustrated in FIG. 6. As the piston 670 moves in this construction, air may be allowed to pass through the holes 720 and fill the space within the interior cylinder section 660 that has just been evacuated by the piston 670, removing some or all of the damping effect discussed in reference to force capacitor 610 depending on the characteristics of the holes such as their diameter. There may be numerous manners of allowing gas to equilibrate from inside to the cylinder to out. In an example of an alternative, there may be grooves in the sidewall of the cylinder that allow gas to leak by the o-ring seals.

Figure 8A:
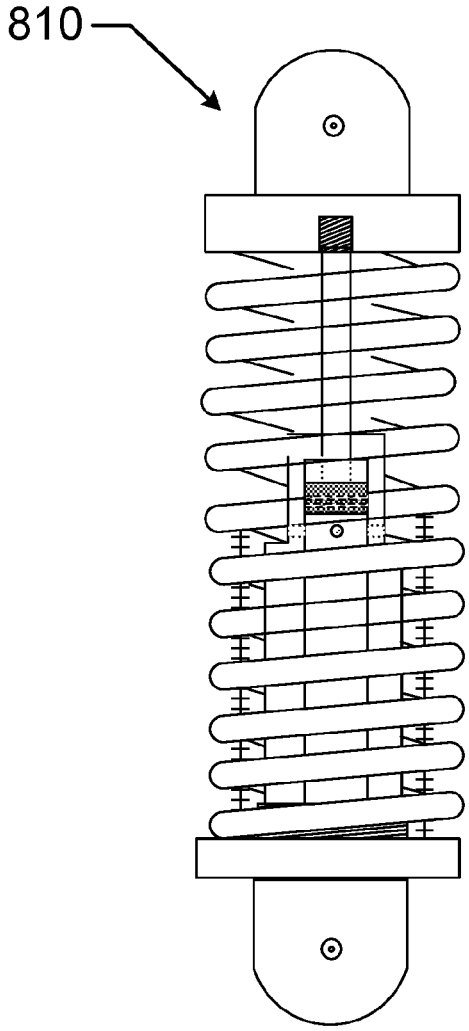
FIG. 8A illustrates aspects of a spring-based force capacitor with a gas compression piston in cylinder complementary function where the cylinder has release holes that allows gas release during the initial movement of the cylinder during discharge of spring tension.
Figure 8B:
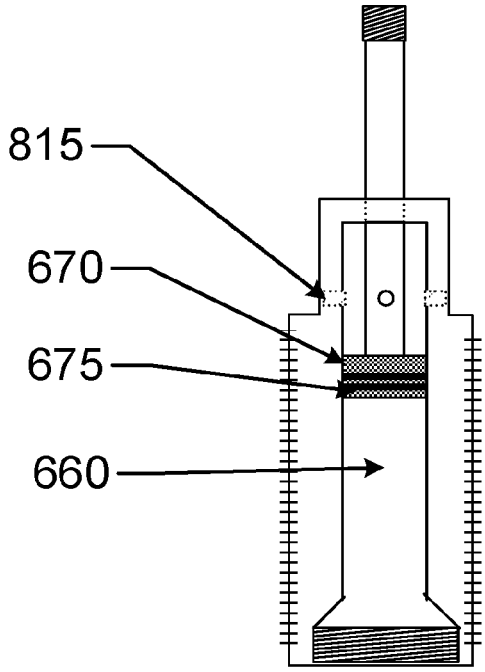
FIG. 8B illustrates aspects of a spring-based force capacitor with a gas compression piston in cylinder complementary function where the cylinder has release holes that allows gas release during the initial movement of the cylinder during release of spring tension.

Referring now to FIGS. 8A and 8B, a similar exemplary force capacitor 810 to that in FIG. 6 is illustrated, with similar operation in many ways except that in this embodiment, holes 815 may be cut in the cylinder 635 at some point along its height. During discharge or release of the spring tension, these holes allow this construction to circumvent compression of gasses in the cylinder until the piston passes the holes 815. As the piston 670 moves in this construction, air pushed by the piston may be allowed to pass through the holes 815 until the cylinder moves past them. As a result the initial compression of the spring may only compress the spring and not gas in the cylinder. In some implementations, the ability of gas to leak into the cylinder may limit a damping effect of the cylinder.

Figure 9A:
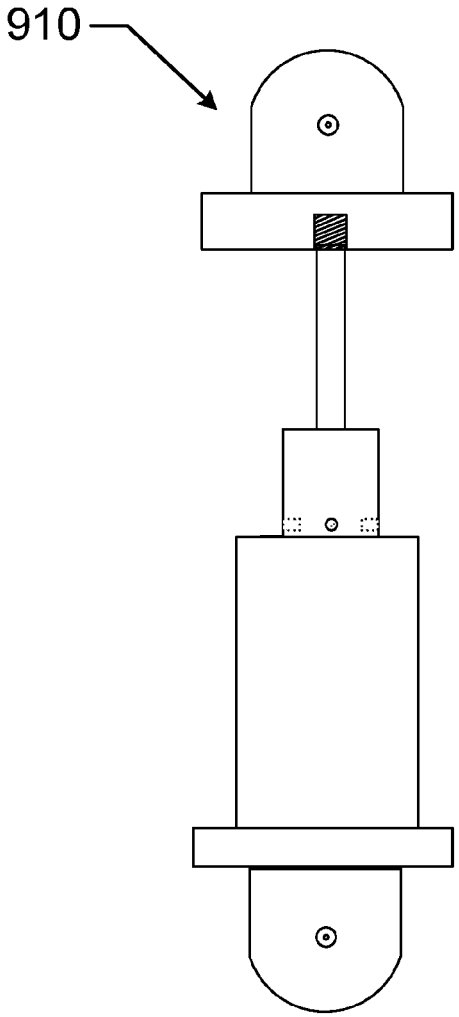
FIG. 9A illustrates aspects of an exemplary magnetic based force capacitor design.
Figure 9B:
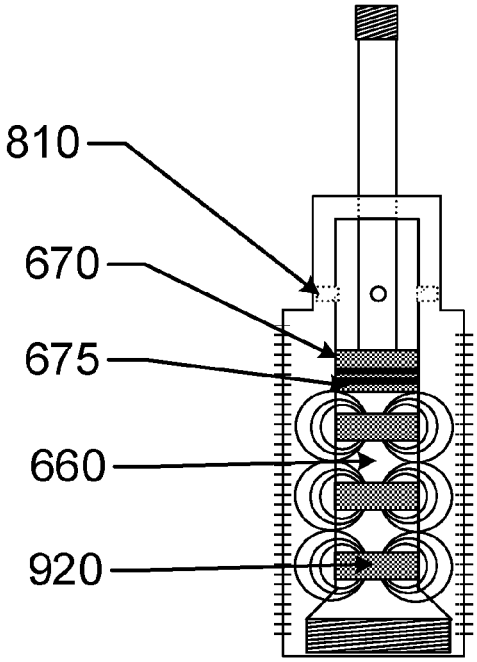
FIG. 9B illustrates aspects of an exemplary magnetic based force capacitor design.
Figure 9C:
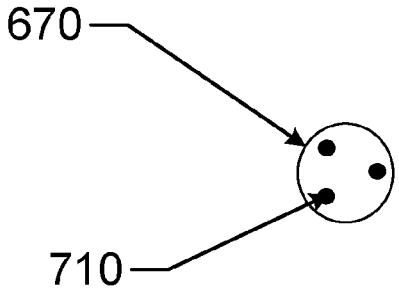
FIG. 9C illustrates aspects of an exemplary magnetic based force capacitor design.

Referring now to FIGS. 9A-9C, an exemplary force capacitor 910 using a plurality of permanent magnets may be seen. In some embodiments, as illustrated, the force capacitor of this type does not possess a spring element 620, for the permanent magnets 920 replace its function. In other implementations, a spring may also be connected. If the permanent magnets 920 are arranged within the interior cylinder section 660 with alternating polarities so that incident sides of adjacent magnets 920 repel each other, the force imparted by the user may be directed towards pushing the magnets 920 together. There may be alternative force and energy storage characteristics when the compressive element is different from a mechanical spring, and, in some embodiments, the force characteristics may not follow the ideal Hooke's law characteristics mentioned previously. Further, the exemplary force capacitor 910, illustrates an example with magnetic compression characteristics, however, other examples such as the use of pneumatics may result in varied compression characteristics.

Figure 10A:
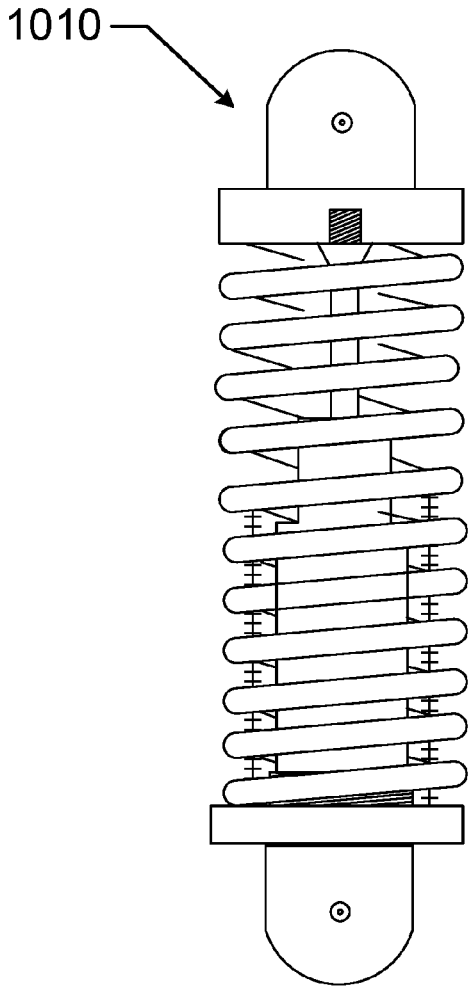
FIG. 10A illustrates aspects with an exemplary tethering element internal to the cylinder.
Figure 10B:
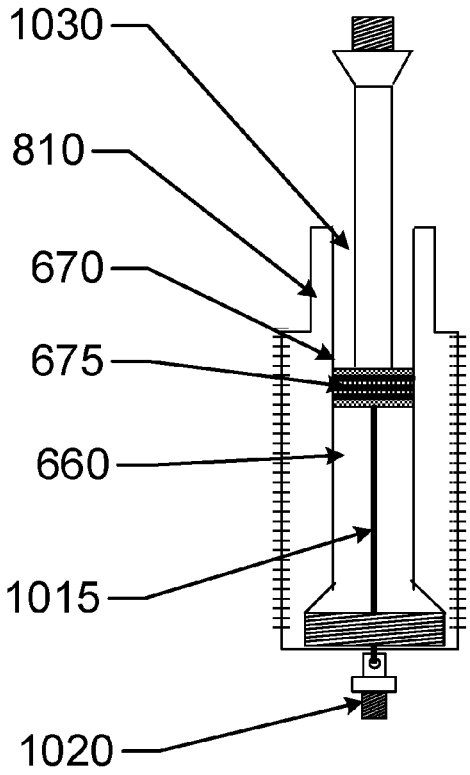
FIG. 10B illustrates aspects with an exemplary tethering element internal to the cylinder.
Figure 10C:
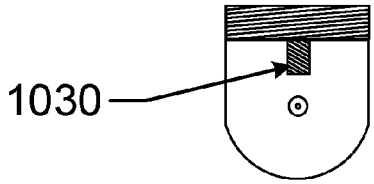
FIG. 10C illustrates aspects with an exemplary tethering element internal to the cylinder.

Referring now to FIGS. 10A-10C, an exemplary force capacitor 1010 using a length of bow string 1015 may be seen. In some embodiments, this exemplary force capacitor 1010 utilizes a spring element 620 to store energy imparted by the user. In some implementations, this exemplary force capacitor 1010 may have an open region 1030 above the piston and therefore does not constrain any air in the region. In some aspects, to achieve damping during the release of energy, this exemplary force capacitor 1010 may have the afore-mentioned length of bow string 1015 attached to the piston 670 on one side and a mounting piece 1020 that may screw into an end cap with matching threads on the other. In some implementations, upon the release of energy, as the spring element 620 decompresses, the bow string may become taut, and stretch to some degree, to decelerate and eventually stop the motion of the force capacitor 610. In some aspects, loss of energy may be limited, and the force capacitor may comprise a binary damper, wherein the damping effect may occur when the arrow is released.

Figure 11:
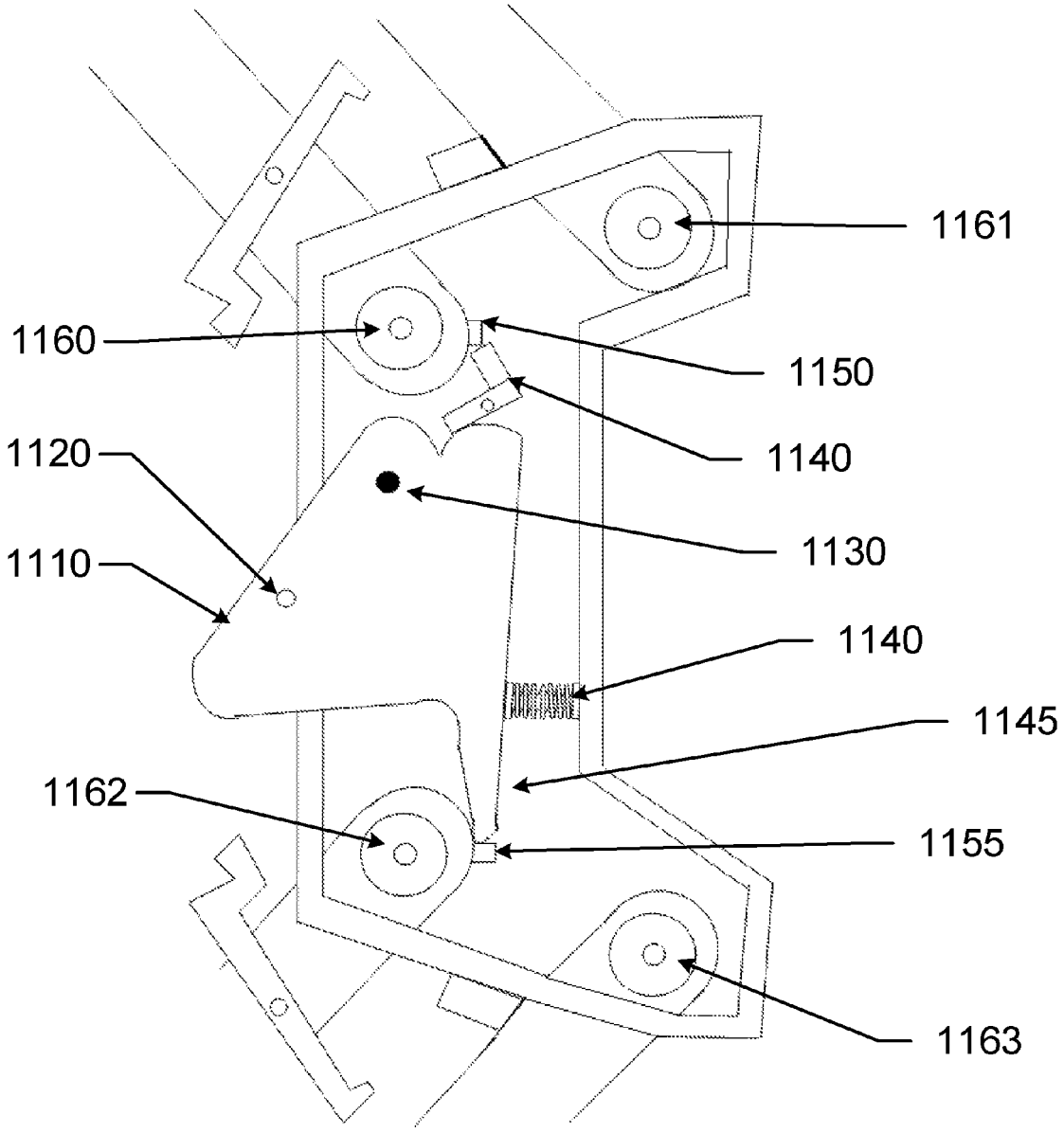
FIG. 11 illustrates an exemplary trigger mechanism for unfolding a foldable bow.

Referring now to FIG. 11, an exemplary trigger deployment system may be seen. In some embodiments, this device may, when actuated, automatically transform the bow it is placed within from a folded position to a deployed position. In some implementations, when the bow is in its folded position a spring 1140 may hold the trigger in a position that may allow the deployment mechanism to be ready to be actuated. In some aspects, to actuate the deployment mechanism the user may squeeze a trigger 1110, which pivots around a pivot pin 1130 and compresses a spring 1140. In some embodiments, a safety 1120 may be activated within the trigger to prevent the user from actuating the deployment system inadvertently. In some implementations, this safety 1120 may consist of a pin placed through a hole, as a non-limiting example. During deployment, the user may squeeze the trigger 1110, causing it to pivot.

In some aspects, due to the geometry of the trigger, this rotation may cause an opposite rotation in an internal stop. In some implementations, in its initial position, the internal stop may prevent the movement of a block 1150 on a pivot joint of the upper limbs of the bow, and thus, the clockwise rotation of the upper limbs. In some aspects, this clockwise rotation may be caused by loaded rotary springs in the limbs' pivot joints 1160, 1161. Similarly, in some embodiments, the bottom of the trigger 1145 may prevent the counter-clockwise rotation of a block 1155 which may stop rotation of the bottom limbs. In some aspects, the bottom limbs motion may be caused by loaded rotary springs 1162, 1163 in these limbs' pivot joints. In some implementations, when the trigger 1110 is squeezed, the obstructed limbs may be free to rotate, and may rotate into their deployed position.

In some embodiments, not shown, the spring system may be replaced with a pressurized gas, such as nitrogen, inside the cylinder. In some aspects, nitrogen may perform the same or similar mechanically at all reasonable temperatures and may not expand or contract with temperature, which may allow for consistent use throughout different seasons and weather. In some implementations, power adjustments may be managed more finely by setting precise pressures, and each force cap may be plumbed together during tuning to create balance between the two halves.

In some embodiments, gas charge may be set and adjusted through a port on the sidewall of the cylinder. In some aspects, an anchor may be used and extended, which may include a smooth shoulder. In some embodiments, a floating piston may be in place with the outside diameter sealed to the cylinder and the inside diameter sealed to the shoulder of the anchor. In some implementations, integrated into the mount point below the cylinder is a fluid or gas port and external quick-disconnect fitting.

In some aspects, separate from the bow is a pedal driven master cylinder that may be connected by a flexible hydraulic line of needed length. In some implementations, the pressurized gas system may be replaced with a bladder on which the user could step such as in a target shoot scenario, or even a bladder integrated into a boot or shoe.

In some embodiments, a user may draw the bow as normal until let-off is engaged. In some implementations, at this point, the user may actuate the master cylinder component. In some aspects, this may drive the piston a calibrated distance in relation to the desired force increase, which may further compress the gas. In some embodiments, the additional force may be stored, and the user may fire the bow as normal. In some aspects, when firing is complete, the user may release pressure on the master cylinder allowing the piston to return to the original position.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described components and systems can generally be integrated together in a single archery product or packaged into multiple archery products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. Nevertheless, it will be understood that various modifications may be made without departing from the spirit and scope of the claimed disclosure.

What is claimed is:

1. An archery bow comprising:

an upper limb;

a lower limb;

a grip portion for grasping the archery bow, wherein the grip portion connects the upper limb and the lower limb;

an upper force capacitor connected to the upper limb, wherein the upper force capacitor allows for an upper let off;

a lower force capacitor connected to the lower limb, wherein the lower force capacitor allows for a lower let off independent of the upper let off;

a drawstring connecting the upper force capacitor and the lower force capacitor, wherein a first draw of the drawstring engages the upper force capacitor, a second draw of the drawstring engages the lower force capacitor, and a release of the drawstring releases both the first draw and the second draw;

an upper eccentric, wherein the drawstring engages the upper force capacitor through a rotation of the upper eccentric;

a lower eccentric, wherein the drawstring engages the lower force capacitor through a rotation of the lower eccentric; and a nock located on the drawstring configured to fit an arrow to the drawstring, wherein the nock travels a first distance during the first draw, a second distance during the second draw, and a third distance during the release, and wherein a summation of the first distance and the second distance exceeds the third distance.

2. The archery bow of claim 1, wherein the upper eccentric comprises a first shape and the lower eccentric comprise a second shape.

3. The archery bow of claim 2, wherein the first shape and the second shape are the same.

4. The archery bow of claim 2, wherein the first shape and the second shape are different.

5. The archery bow of claim 1, further comprising a folded orientation and a deployed orientation, wherein the archery bow is operable in the deployed orientation.

6. The archery bow of claim 5, wherein the upper limb comprises a first folding point, the lower limb comprises a second folding point, a connection point between the grip portion and the upper limb comprises a third folding point, and a connection point between the grip portion and the lower limb comprises a fourth folding point.

7. The archery bow of claim 5, further comprising a folded locking mechanism, wherein the folded locking mechanism secures the archery bow in the folded orientation.

8. The archery bow of claim 5, further comprising a deployed locking mechanism, wherein the deployed locking mechanism secures the archery bow in the deployed orientation.

9. The archery bow of claim 1, wherein the force capacitor is configured to disassemble.

10. The archery bow of claim 1, further comprising a release mechanism configured to release the drawstring once engaged.

11. The archery bow of claim 10, wherein the release mechanism is located on the grip portion.

12. The archery bow of claim 10, wherein the release mechanism is located on one or both the lower limb or the upper limb.

13. The archery bow of claim 1, wherein the drawstring comprises a noise dampening material.

14. The archery bow of claim 1, wherein the upper force capacitor comprises a first spring system and the lower force capacitor comprises a second spring system.

15. The archery bow of claim 1, wherein the upper force capacitor comprises a first pneumatic mechanism and the lower force capacitor comprises a second pneumatic mechanism.

16. The archery bow of claim 1, wherein the upper force capacitor comprises a first magnetic mechanism and the lower force capacitor comprises a second magnetic mechanism.

* * * * *